United States Patent [19]

Kay

[11] Patent Number: 4,585,422

[45] Date of Patent: Apr. 29, 1986

[54] TOY CONSTRUCTION KIT

[76] Inventor: Albert E. Kay, 79 Orton Park Road, Scarborough, Ontario M1G 3G7, Canada

[21] Appl. No.: 641,771

[22] Filed: Aug. 17, 1984

[51] Int. Cl.[4] ..... A63H 33/08

[52] U.S. Cl. ..... 446/106; 446/476

[58] Field of Search ..... 446/106, 108, 109, 110, 446/111, 112, 113, 114, 115, 116, 122, 123, 124, 476; 52/233

[56] References Cited

U.S. PATENT DOCUMENTS

| | | | |
|---|---|---|---|
| 1,271,180 | 7/1918 | Lavanchy | |
| 1,311,337 | 7/1919 | Fredson | 446/114 |
| 1,402,438 | 1/1922 | Nichols | 446/106 |
| 2,104,742 | 1/1938 | Fleischer | 446/106 |
| 2,712,199 | 7/1955 | Latimer | 446/106 |
| 3,570,169 | 3/1971 | Jacob | 446/106 |
| 3,604,146 | 9/1971 | Winer | 446/122 |
| 4,270,304 | 6/1981 | Sofer | 446/106 |

FOREIGN PATENT DOCUMENTS

| | | | |
|---|---|---|---|
| 132550 | 5/1949 | Australia | 446/114 |
| 329265 | 9/1935 | Italy | 446/108 |

*Primary Examiner*—Mickey Yu

*Attorney, Agent, or Firm*—Ridout & Maybee

[57] ABSTRACT

A toy construction kit particularly useful in constructing architectural models, such as structural bridges and the like. The kit includes a number of elongated members having parallel notches along their edge that are spaced apart at equal intervals or at multiples thereof. The notches are capable of receiving a notched edge or end, of another member in crosswise mating. Some of the elongated members have notched ends, also capable of engaging other members in the kit, and at least one of the elongated members is curved with all of its notches formed parallel. As all of the pieces interlock together, various structural models may be assembled and disassembled without the use of tools or any other type of hardware.

1 Claim, 6 Drawing Figures

TOY CONSTRUCTION KIT

BACKGROUND OF THE INVENTION

1. Field of the Invention

The present invention relates generally to a toy construction kit which can be used in constructing models requiring arched beams, such as structural bridges and the like.

2. Description of the Related Art

Many previously known toy construction kits have been useful for constructing variations on a log-cabin model.

Kits with slotted geometric-shaped pieces have included those disclosed in U.S. Pat. Nos. 3,991,511—McAllister et al and 3,570,169—Jacob. However, the shapes and notching of the pieces have limited those kits to specific toy construction uses.

SUMMARY OF THE INVENTION

The toy construction kit of the present invention is directed toward providing suitable components for construction of structurally solid, realistic looking architectural models, such as of bridges, which allow assembling and disassembling without the use of tools or any type of hardware.

The various component parts can also be used to build tower-type structures and various other shapes, circular, square, angular or triangular.

In the kit of the present invention, elongated members of several different shapes are provided which universally interlock with an interference fit for construction of a large variety of different structures.

The shapes are essentially comprised of straight-edge members and curved-edge members.

Notches provided at modular intervals along edges or provided in ends of members, permit the joining of members by cross-wise interlock, and provide a sturdy connection capable of supporting elaborate structures. Hence, multilevel structures in various lengths and sizes can be built.

The lengths of the members are based on the same modular intervals as the notching, increasing the variety of structures capable of being constructed from the kit by the universal fit in two dimensions of the member components.

End notching of some of the members provides the ability to join together single structures to form unlimited lengths of various designs.

According to the present invention, there is provided a toy construction kit consisting of a plurality of elongated members. At least one of the elongated members has a curved edge, and along said curved edge, has a plurality of parallel notches each capable of receiving an edge or an end of other elongated members to join the latter to the curved edge.

Preferably, the other members have edges with parallel notches therein, and the members can be joined by bringing them together at their notches, all the notches being on planes spaced apart along the edges at equal intervals or multiples thereof.

DESCRIPTION OF THE PREFERRED EMBODIMENT

Figure 1:
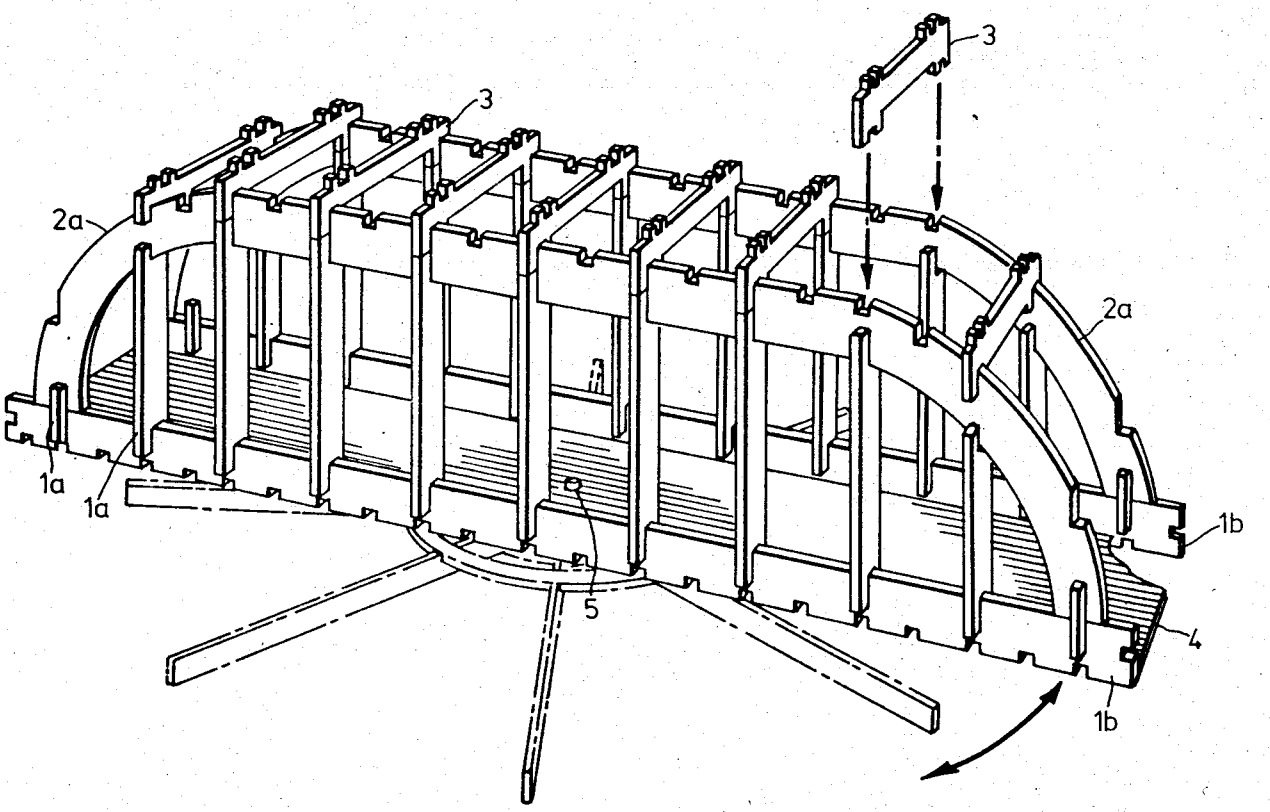
FIG. 1 is a perspective view of a toy or model structural bridge mounted on a pivot assembly, all constructed of component members of the kit, and illustrating one application of the invention in practice.

In the drawings, 1 denotes one of a plurality of linear members. The members are not of uniform length, but there is a general relationship between the lengths and widths of all members and the spacing of the notches defined in the members, such that the components of the kit will be universally mutually-compatible in model constructions.

The linear members fall into two general categories; members having notched ends and smooth edges 1*a*, and members having notched edges 1*b*. The members with notched edges may or may not have notched ends, and also, the ends of such members may be parallel or, as in FIG. 2, may be outwardly angled 1*c*. Notching along the edges of all members 1 is in planes spaced at equal intervals or at multiples thereof.

As shown in FIG. 1, an edge-notched member 1*b* may be disposed horizontally, and an end-notched member 1*a* vertically, so that the end-notched member 1*a* can be lowered in alignment with a notch of the edge-notched member 1*b*, and the two members thereby fit snugly together in interlocking engagement.

It will be seen from FIG. 1 that, in addition to linear members, the kit of the invention also comprises curved members, generally designated by 2. The curved members are provided with notched edges; the notches being parallel and in planes spaced apart along the edges at equal intervals or at multiples thereof as in the linear members 1.

Preferably, most of the edge-notches on the linear members are parallel, and the end-notches are in alignment with opposite end notches, so that the curved members 2 may be interlocked with such linear members. It will become apparent from the following description that the parallel notching on other members allows them also to be interlocked with curved members.

Members, such as end-notched members 1*a* are of graduated lengths based on the same equal intervals or multiples thereof, so as to be useable as braces and compatible between members of different shapes.

By way of illustration, the invention can be practised as shown in FIG. 1 where two single arch members 2*a* are provided. The notching of each single arch member aligns with corresponding notching of a side-notched member 1*b*. All notching being parallel, end-notched members 1*a* can be used as braces between each pair of a side-notched member 1*b* and a single-arch member 2*a* to construct one side or wall of a model.

Cross-brace members 3 with outwardly protruding notches are used to connect between assembled sides or walls of a model, as shown in FIG. 1. The outwardly protruding notches are also in planes spaced apart at equal intervals or at multiples thereof, as with other members.

The cross-brace members 3 may be elongated and provided with one or more additional pairs of opposite outwardly protruding notches so as to brace or connect between three or more assembled sides or walls of a model bridge or the like.

Figure 5:
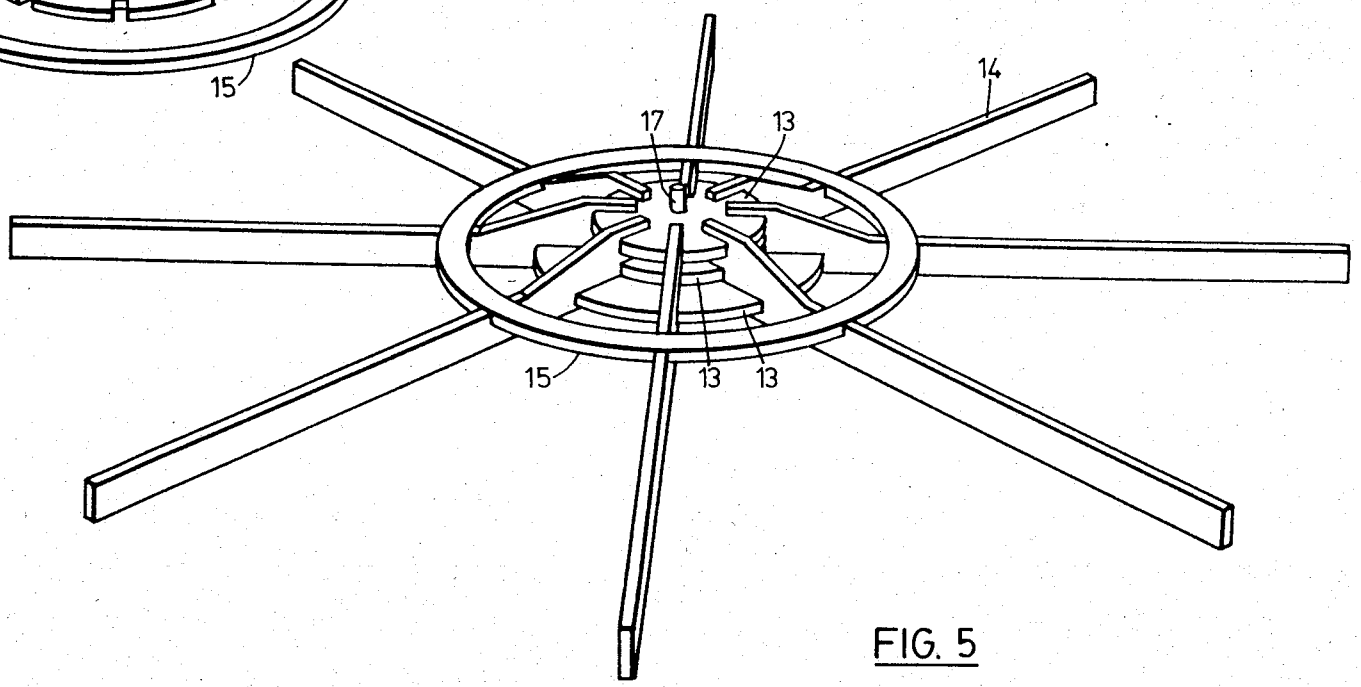
FIG. 5 is a perspective view of the pivot assembly of FIG. 1.
Figure 6:
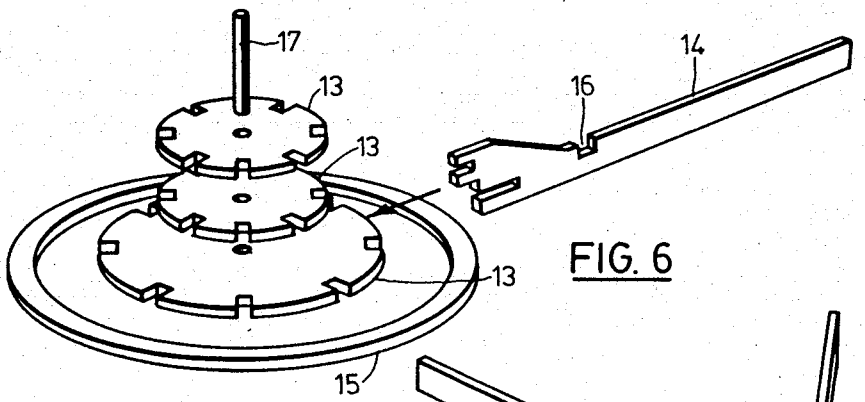
FIG. 6 is an exploded view of the pivot assembly of FIG. 5 illustrating the component members thereof.

In FIG. 1, the bridge assembly has been provided with a roadbed 4 having defined at a central point an aperture 5 to allow mounting on a pivot assembly, shown in broken outline, which is more fully illustrated in FIGS. 5 and 6.

The end-notched members 1*a* are provided in graduated lengths, so as to provide interlocking connection between curved members 2 and members of different forms, such as edge-notched members 1*b* (FIG. 1).

Figure 2:
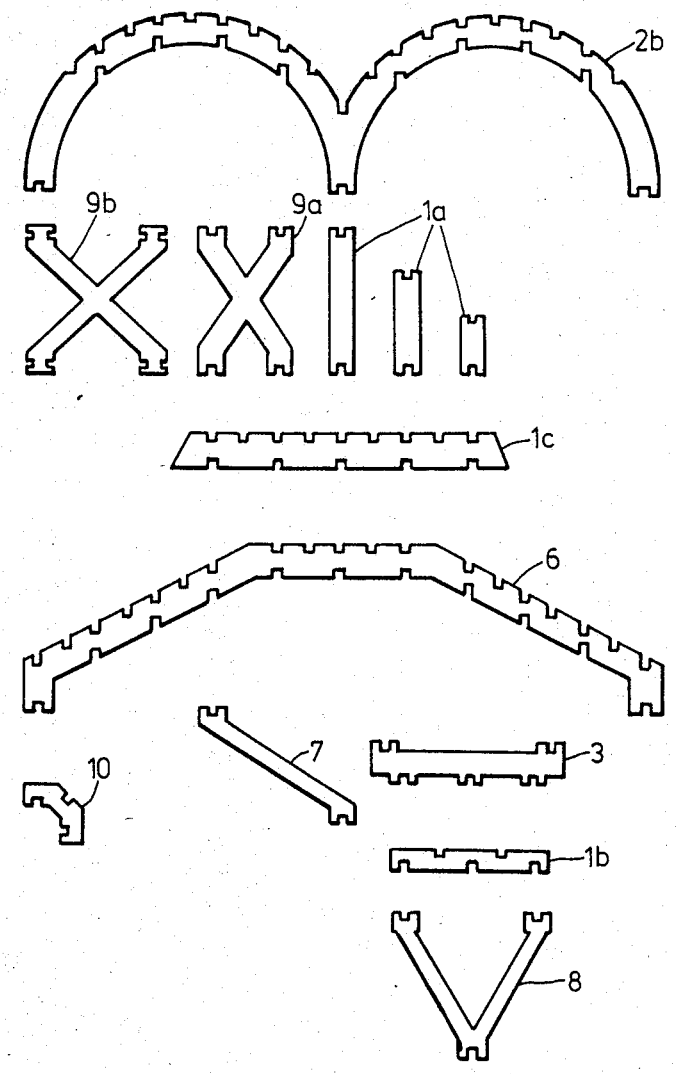
FIG. 2 illustrates an array of possible shapes for component members of a toy construction kit.

FIG. 2 illustrates an array of possible alternate forms for component members of the kit emphasizing the alignment of notching due to spacing based on equal intervals or multiples thereof. Linear members are provided: end-notched members 1*a* in graduated lengths, edge-notched members 1*b* with parallel ends and angled-end members 1*c*, as well as the cross-brace member 3 illustrated in FIG. 1. A variation on the curved member of FIG. 1 is shown in FIG. 2 as a double-arch member 2*b*. Also illustrated are linear members with inclined sides 6, and diagonal braces having end notches inclined to the lengths of their members but parallel to each other, such members having two notched ends 7, three-notched ends 8 and four notched ends 9. The linear member with inclined sides 6 could, in one function, replace a curved member. Any of the brace members can be used, for example, in place of the end-notched members 1*a* as diagonal braces (see FIG. 4), or for any other obvious purpose in toy construction. In addition, brace-members can serve as braces between two, three or four elongated members, simply by disposing the braces across said elongated members, or along the elongated members connected with small end-notched members 1*a*.

Main structures may be designed, and all other interlocking parts can be used horizontally, vertically, angularly and adjacent to the main structure. The mode of connection based on parallel notches spaced at equal intervals or at multiples thereof enables all components to fit together and provide the means for adding on components almost indefinitely.

In addition, it will be obvious that the components of the kit are not limited to those illustrated in the Figures. As illustrated in FIG. 2, the diagonal brace with four notched ends may be designed as 9*a* or may have notches disposed at right angles as in member 9*b*. The same principle applies to the diagonal brace with two notched ends 7, or to any other member capable of alteration, but still allowing interconnection with other members.

Also, an end-notched member 1*a* could be modified to a hook-end form, with parallel notches defined between the hook portion and edge portion of the member.

Another component illustrated in FIG. 2 is a cornering member 10. The inwardly directed notches may be used to connect parallel linear members in a concave corner, while the outwardly directed notch may be used to add additional components or structures.

As is illustrated in FIG. 2, a modification on the edge-notched member shown in FIG. 1, is to provide notches on opposite acutely-intersecting planes toward either end of the member. A complimentary member, with opposite obliquely-angled notches could also be provided, allowing for construction of models having both straight and sloped interconnecting members (see FIG. 4).

Other forms of curved members, linear members and brace members may be used in the kit in order to increase the possible structural combinations.

Figure 3:
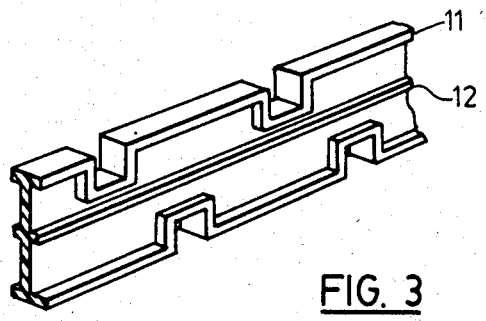
FIG. 3 is a perspective view of a section of one of the component members in a preferred embodiment of the invention.

Preferably, the component members will be constructed of plastic which is an inexpensive and easily moldable material. To reduce costs of manufacture even further, members can be manufactured very thin, with a peripheral lip 11 and a central lip 12, shown in FIG. 3, providing the necessary strength to withstand the stress of interlocking and unlocking. The central lip 12 additionally provides abutment for the peripheral lip 11 of an interlocking member to stabilise the connection.

It will be obvious that other materials may be used, such as wood or metal. In the case of harder materials, the peripheral and central lips may not be necessary to provide a certain rigidity to the edge and centre, in which case, the lips may be left off and the dimensions of the notches altered accordingly to permit snug interlocking.

Figure 4:
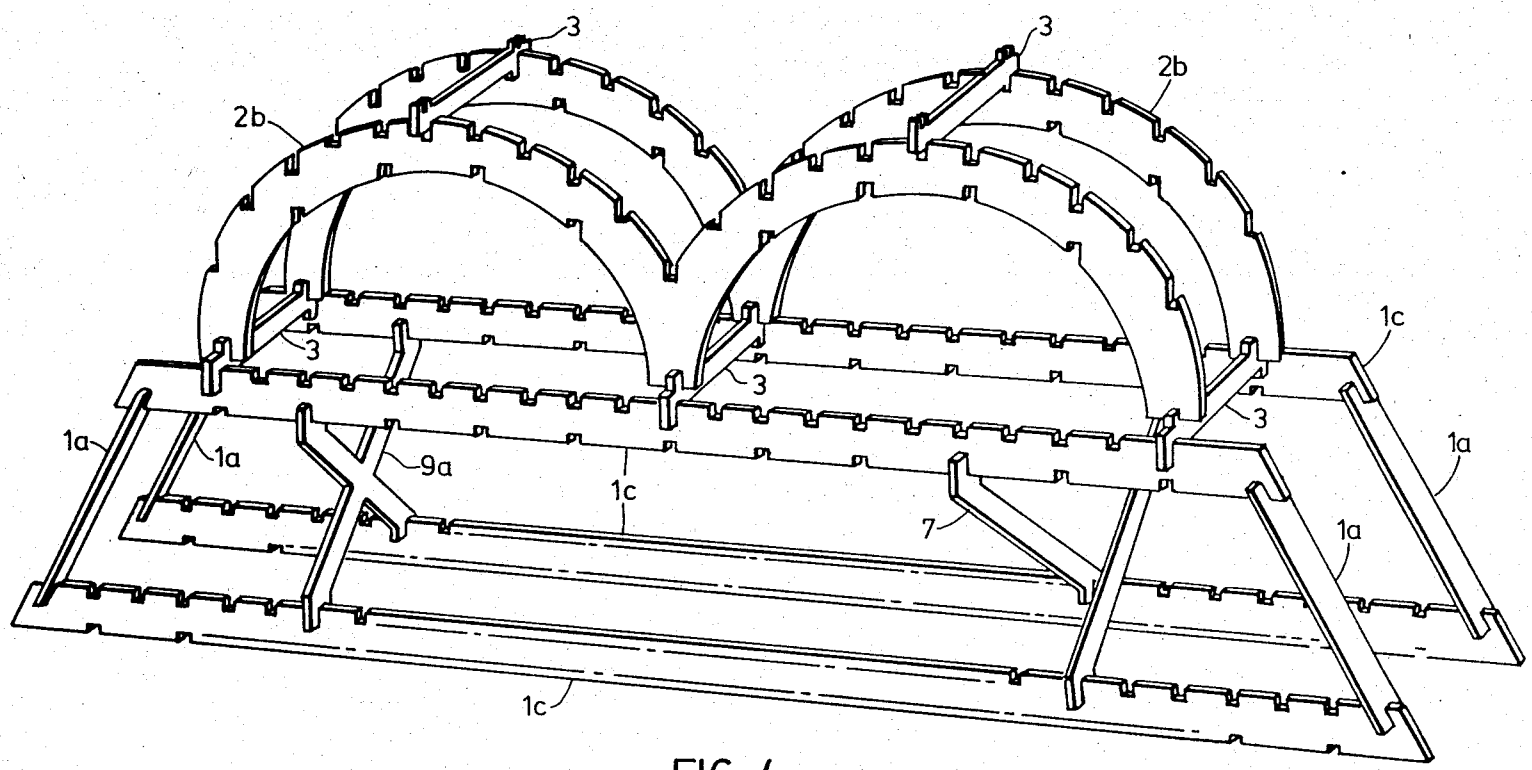
FIG. 4 is a perspective of another toy or model constructed of additional component members of the kit to those illustrated in FIG. 1.

FIG. 4 illustrates a partially complete construction utilising the double arch member 2*b* illustrated in FIG. 2.

In addition, complementary angled-end members 1*c* have been used, connected by end braces in the form of end-notched members 1*a* and diagonal braces with either four-notched ends 9*a* or two-notched ends 7.

Cross-brace members 3 are again used to connect between assembled sides or walls, and the function of the inwardly disposed protruding notches of said cross-brace members can be seen both as a connector between different levels of elongated members, and as a connecting brace between parallel elongated members.

By way of example, it should be pointed out that the construction comprising complementary angled-end members 1*c* with interconnecting, outwardly-flaring end-notched members 1*a* could be replaced, for a similar effect, by the linear member with inclined sides 6 connected with a side-notched member 1*b*, both of which are illustrated in FIG. 2.

The variety of functions to which members such as the linear member with inclined sides 6 may be put, illustrates the versatility of the kit in model construction.

FIG. 5 illustrates the pivot assembly shown in broken outline in FIG. 1, which is constructed of supplementary component members. These supplementary component members may be included in the main kit, or provided as supplementary thereto to permit construction of other models or toys.

FIG. 6 is an exploded view of FIG. 5, illustrating the component members of the pivot assembly and their interlocking relationship.

A number of disks 13 are provided, having graduated diameters and centrally-directed notches.

The notches of the disks 13 are adapted to receive the notched ends of several elongated members 14. The elongated members 14, have notches defined of varying depths, so as to receive the disks of different diameters in snug-fitting interlock.

An annular ring 15 may also be provided to rest in a channel 16 formed in one edge of the elongated member 14. Also a peg 17 maybe inserted through a central hole defined in the disks 13 for centering of said disks in alignment.

It will be obvious from the foregoing description that the several components of the kit of my invention can be modified to provide a greater variety, utilising at all times the principles of having notching spaced apart along edges of members at equal intervals or at multiples thereof on the basic members, and having such notching on curved members parallel to allow for alignment with parallel notching in linear members of the kit. In addition to the particular assemblies described above and in the drawings, the various component members can also be used to build tower-like structures and various other shapes that suit the imagination of a child or adult.

I claim:

1. Toy construction kit, comprising:

(a) a plurality of linear members having ends with notches therein, and having edges with a plurality of notches therein in parallel planes spaced apart at equal intervals or multiples thereof, and (b) a curved member having parallel edges with a plurality of notches therein in parallel planes spaced apart at said equal intervals or multiples thereof, and having ends with notches therein parallel to its edge notches and spaced apart at said equal intervals or multiples thereof, wherein all of said notches are capable of receiving, in cross-wise mating, a notch of another member, whereby different structures can be constructed of some of the linear members and the curved member.

* * * * *